US006043812A

United States Patent [19]

Utsunomiya et al.

[11] Patent Number: 6,043,812

[45] Date of Patent: Mar. 28, 2000

[54] LIQUID CRYSTAL DRIVE CIRCUIT AND LIQUID CRYSTAL DISPLAY DEVICE

[75] Inventors: Takanori Utsunomiya, Oita; Hidehiko Tachibana, Yokohama, both of Japan

[73] Assignee: Kabushiki Kaisha Toshiba, Kawasaki, Japan

[21] Appl. No.: 09/052,942

[22] Filed: Apr. 1, 1998

[30] Foreign Application Priority Data

Apr. 1, 1997 [JP] Japan ..... 9-082856

[51] Int. Cl.[7] ..... G09G 3/36

[52] U.S. Cl. ..... 345/204; 345/87; 345/98; 345/100

[58] Field of Search ..... 345/87, 98, 100, 345/204

[56] References Cited

U.S. PATENT DOCUMENTS 5,404,151 4/1995 Asada ..... 345/100

5,903,250 5/1999 Lee et al. ..... 345/100

*Primary Examiner*—Bipin Shalwala

*Assistant Examiner*—Vincent E. Kovalick

*Attorney, Agent, or Firm*—Foley & Lardner

[57] ABSTRACT

Output circuits OC1–OC240 supplied with picture signals VIN to output drive signals are provided. Each of the output circuits OC includes a switching element SW1, a capacitor C1 and a switching element SW2 provided at a first path, and a switching element SW3, a capacitor C2 and a switching element SW4 provided at a second path connected in parallel with the first path, and includes a sample-hold circuit SH1 supplied with a picture signal and a hold switching signal of which level is switched at a first period to alternately store the picture signal into the capacitor C1 or the capacitor C2 in accordance with hold switching signal to output it, and an amplifier AMP1 supplied with an output of this circuit SH1 to amplify that output to output it as a drive signal. Further, buffers are provided every output circuits OC. These buffers are connected to each other in series. Hold switching signal inputted from the external is inputted to the buffers and are propagated therethrough. Thus, outputs from respective buffers are delivered to corresponding output circuits OC. By providing such configuration, in accordance with this invention, it is suppressed that rounding of waveform takes place by the influence of wiring resistor and/or parasitic capacitor for a time period during which hold switching signal is transferred through the signal line and feed-through current in carrying out switching operation is thus increased so that power consumption become large.

20 Claims, 9 Drawing Sheets

LIQUID CRYSTAL DRIVE CIRCUIT AND LIQUID CRYSTAL DISPLAY DEVICE

BACKGROUND OF THE INVENTION

This invention relates to a liquid crystal drive circuit and a liquid crystal display device using such a drive circuit.

In the liquid crystal display device, a liquid crystal drive circuit adapted for outputting a picture signal to drive the liquid crystal panel is used. The configuration of a drive circuit related to this invention is shown in FIG. 6. This drive circuit includes, every respective stages, sample hold circuits of the two latch system, and serves to carry out switching of hold operations of picture signals by using a signal given from the external of the chip.

For example, output circuits OC1–OC240 of 240 stages are disposed and respective output circuits OC1–OC240 are supplied with picture signals VIN. Further, hold switching signal CX is delivered from the external of the chip and is amplified by buffer composed of inverters IN2241 and IN 2242. Thereafter, the signal thus amplified is transferred through wiring W as hold switching signal CXD and is then delivered to respective output circuits OC1–OC240.

The output circuits OC1–OC240 respectively have the same configurations. Explanation will be given by taking the example of output circuit OC1. The output circuit OC1 includes a sample-hold circuit SH1, an amplifier AMP1 and an output terminal OUT1.

The sample-hold circuit SH1 includes a buffer composed of inverters IN2001*a* and IN2001*b*, a switching element SW1 composed of an N-channel type MOS transtor N1 and a P-channel type MOS transistor P1, a switching element SW2 composed of an N-channel type MOS transistor N2 and a P-channel type MOS transistor P2, a switching element SW3 composed of an N-channel type MOS transistor N3 and a P-channel type MOS transistor P3, a switching element SW4 composed of an N-channel type MOS transistor N4 and a P-channel type MOS transistor P4, and capacitors C1 and C2.

The inverter IN2001*a* is supplied with hold switching signal CXD to output hold switching signal CX1B. The inverter IN2001*b* is supplied with this hold switching signal CX1B to output hold switching signal CX1. The switching elements SW1 and SW2 are connected in series through node ND1, and the switching elements SW3 and SW4 are connected in series through node ND2 in a manner in parallel with these switching elements SW1 and SW2. Control signals A, /A, B, /B are respectively inputted to gates of transistors N1, P1, N3 and P3, and the above-mentioned hold switching signals CX1, CX1B, CX1B and CX1 are respectively inputted to gates of transistors N2, P2, N4 and P4. Thus, ON/OFF operations are controlled. In addition, the capacitor C1 is connected between the node ND1 and ground terminal and the capacitor C2 is connected between the node ND2 and ground terminal.

Output terminal ND3 of the sample-hold circuit SH1 is connected to the non-inverting input terminal of the amplifier AMP1. Output terminal of the amplifier AMP1 is connected to the inverting input terminal so that negative feedback loop is applied. The output terminal of the amplifier AMP1 is connected to output terminal OUT1. Thus, the same voltage as that of the node ND3 is outputted as output voltage OUT1.

The operation of the sample-hold circuit SH1 will now be described with reference to the time chart of FIG. 7 showing waveforms of respective signals. The hold switching signal CX inputted from the external is adapted so that switching between high level and low level is carried out every period of one cycle. This hold switching signal CX is inputted to respective output circuits OC1–OC240 through inverters IN2241 and IN2242. Thus, hold switching signals CXi (i is integer ranging from 1 to 240) which are the same as the signal CX in the logic level are generated by inverters IN2001*a* and IN2001*b*.

Picture signal VIN which takes voltage V0 at the cycle 1 and changes to voltage V1 in the process from the cycle 1 to the cycle 2 is inputted to the switching elements SW1 and SW3. The switching element SW1 is turned ON when control signal A in pulse form which takes high level at cycles 1, 3, 5 . . . is inputted thereto, and the switching element SW3 is turned ON by control signal B in pulse form which takes high level at cycles 2, 4, 6 . . .

At the cycle 1, the switching element SW1 is supplied with control signal A so that it is turned ON, but the switching element SW2 is supplied with hold switching signal CX1 of low level so that it is in OFF state. Thus, picture signal VIN of voltage V0 is passed through the switching element SW1. As a result, charges corresponding to voltage V0 of the node ND1 are stored into the capacitor C1. One switching element SW3 is maintained in OFF state. When the operation shifts to the next cycle 2, hold control signal CX of high level is delivered to the switching element SW2 so that it is turned ON. As a result, voltage V0 corresponding to charges stored in the capacitor C1 is produced from the node ND3, and is inputted to the amplifier AMP1.

At the cycle 2, the switching element SW1 is maintained in OFF state, the switching element SW3 is supplied with control signal B so that it is turned ON, and the switching element SW4 is placed in OFF state. Picture signal VIN having voltage V1 is passed through the switching element SW3. As a result, voltage (potential) of the node ND2 becomes equal to voltage V1. Thus, charges are stored into the capacitor C2. When the operation shifts to the next cycle, the switching element SW4 is turned ON. Thus, voltage V1 corresponding to charges of the capacitor C2 is produced at the node ND3, and is inputted to the amplifier AMP1.

In a manner as stated above, in respective output circuits OC1–OC240, voltages V0, V1, . . . are respectively outputted from the sample-hold circuits SH1. These voltages are outputted to the external as voltages OUT1–OUT240 through the amplifiers AMP1.

However, there were problems as described below in the liquid crystal drive circuit shown in FIG. 6. In FIG. 8, there is shown a circuit equivalent to the buffer composed of inverters IN2241, IN2242 supplied with hold switching signal CX, the signal line W for transferring hold switching signal CXD outputted from this buffer, and the output circuits OC1–OC240. These output circuits OC1–OC240 are arranged in row (parallel) because of restriction of wiring pattern on the chip. At the signal line W for transferring hold switching signal CXD, for a time period until that signal is inputted to the inverters IN within the respective output circuits OC1–OC240, there exist wiring resistors r0, r1, . . . , rn, . . . , rm, and parasitic capacitors C0, C1, . . . Cn, . . . , Cm.

When the hold switching signal CXD is passed through such wiring where wiring resistors and parasitic capacitors exist, waveforms of signals CXD1–CXD240 are caused to be waveform of which edge portions are gradually rounded as shown in FIG. 9. When such hold switching signals CXD1–CXD240 are inputted to inverters IN within the respective output circuits OC1–OC240, feed-through currents I (CXD1–CXD240) as shown in FIG. 9 are produced. According as rounding of the waveform of the signals CXD is developed, feed-through currents I (CXD) of the inverters IN are also increased. For this reason, in this circuit, there was the problem that power consumption is large.

Moreover, when the hold switching signal is transferred through the wiring W, the delay time of signal is short. For this reason, hold switching signal is delivered to all output circuits OC1–OC240 in the state where it is hardly delayed. Thus, switching elements carry out ON/OFF operations substantially at the same timing. As a result, noise followed by switching operation was superimposed on signal of the power supply line, resulting in the possibility that erroneous operation may take place.

SUMMARY OF THE INVENTION

Accordingly, an object of this invention is to provide a liquid crystal drive circuit capable of reducing power consumption and preventing erroneous operation by noise, and a liquid crystal display device using such a drive circuit.

In accordance with this invention, there is provided a liquid crystal drive circuit in which there are provided n number of output circuits supplied with picture signals to generate drive signals for driving a liquid crystal panel to output them, each of the output circuits comprising a sample-hold circuit including a first charge storage section and a second charge storage section connected in parallel, the sample hold circuit being supplied with the picture signal and a hold switching signal to store the picture signal into either one of the first charge storage section and the second charge storage section after (that picture signal has) alternately undergone switching in accordance with the hold switching signal to output it therefrom, waveform shapers being provided every the output circuits, the waveform shapers being connected to each other in series, the hold switching signal being inputted to the waveform shapers so that they are propagated in succession, outputs from the respective waveform shapers being delivered to corresponding ones of the output circuits.

In this case, the sample-hold circuit may be adapted so that the first charge storage section is provided at a first path, and the second charge storage section is provided at a second path connected in parallel with the first path, and that it is supplied with the picture signal and the hold switching signal of which level is switched every predetermined period to store the picture signal into either one of the first charge storage section and the second charge storage section after alternately undergone switching in accordance with the hold switching signal to output it therefrom. Moreover, the liquid crystal drive circuit may further include amplifiers supplied with outputs of the sample-hold circuits to amplify those outputs to output them as the respective drive signals.

Alternatively, the sample-hold circuit may be adapted so that both ends of a first switching element, the other end of a first capacitor corresponding to the first charge storage section and having one end grounded and both ends of a second switching element are connected in series so that the first path is formed; both ends of a third switching element, the other end of a second capacitor corresponding to the second charge storage section and having one end grounded and both ends of a fourth switching element are connected in series so that the second path is formed; the second switching element and the fourth switching element are respectively turned ON or OFF on the basis of either the hold switching signal or the inverted hold switching signal; and the first switching element and the third switching element are respectively turned ON or OFF on the basis of either a control signal to produce pulse once every predetermined period which is the same as that of the hold switching signal or the inverted control signal.

Moreover, the waveform shapers are constituted as respective inverter trains in which first inverters and second inverters are respectively provided every the output circuits and connected to each other in series, the hold switching signal being propagated by the inverter trains, hold switching signal outputted from the first inverter and hold switching signal outputted from the second inverter of corresponding one of the respective output circuits being respectively delivered to the second and fourth switching elements within the corresponding output circuit.

In this example, in place of providing waveform shapers at the respective output circuits, p (p is integer smaller than the n) number of output circuits may be caused to be one block so that waveform shapers are provided every respective blocks. In this case, the waveform shapers are connected to each other in series, the hold switching signal inputted from the external being inputted to the waveform shapers so that they are propagated, outputs from the respective waveform shapers being delivered to the output circuits belonging to corresponding blocks.

Further, a liquid crystal display device of this invention is directed to a liquid crystal display device using either one of the above-mentioned liquid crystl drive circuits, the liquid crystl display device comprising: pixel electrodes arranged in a matrix form of n×m (n, m are integer of 2 or more); (n×m) number of liquid crystal drive transistors disposed respectively corresponding to the pixel electrodes and having their drains respectively connected to corresponding ones of the pixel electrodes; n number of data lines having their one ends respectively connected to sources of the liquid crystal drive transistors; m number of gate lines having their one ends respectively connected to gates of the liquid crystal drive transistors; gate drivers connected to the other ends of the gate lines and operative to drive the gate lines in succession in accordance with a first period; and source drivers connected to the other ends of the data lines and such that there are provided plural output circuits supplied with picture signals to generate data line drive signals for driving the data lines to output them, the output circuits of the source drivers respectively comprising sample-hold circuits each including a first charge storage section and a second charge storage section connected in parallel, the sample-hold circuit being supplied with the picture signal and a hold switching signal to store the picture signal into either one of the first charge storage section and the second charges storage section after alternately undergone switching in accordance with the hold switching signal to output it therefrom, waveform shapers being further provided every the output circuits, the waveform shapers being connected to each other in series, the hold switching signal being inputted to the waveform shapers so that they are propagated in succession, outputs from the respective waveform shapers being delivered to the corresponding output circuits.

In accordance with the liquid crystal drive circuit and the liquid crystal display device of this invention as stated above, respective one waveform shapers for (waveform-) shaping waveform of hold switching signal are provided every respective output circuits or with respect to p number of output circuits and are connected in series. Further, such hold switching signal is transferred and is delivered to the respective output circuits. For this reason, at the time point when this signal is delivered to the respective output circuits, rounding of edge of the waveform is suppressed. As a result, feed-through current of the inverter operative by this signal is decreased. Thus, power consumption is reduced. In addition, since there is employed a scheme to transfer the hold switching signal by inverters, slight delay takes place by the time when the hold switching signal is delivered to respective output circuits. Resultantly, difference of timing takes place in the switching operation in the respective output circuits. For this reason, noise by the switching operation is not superimposed. Thus, erroneous operation is prevented.

DESCRIPTION OF THE PREFERRED EMBODIMENTS

Respective preferred embodiments of this invention will now be described with reference to the attached drawings.

Figure 1:
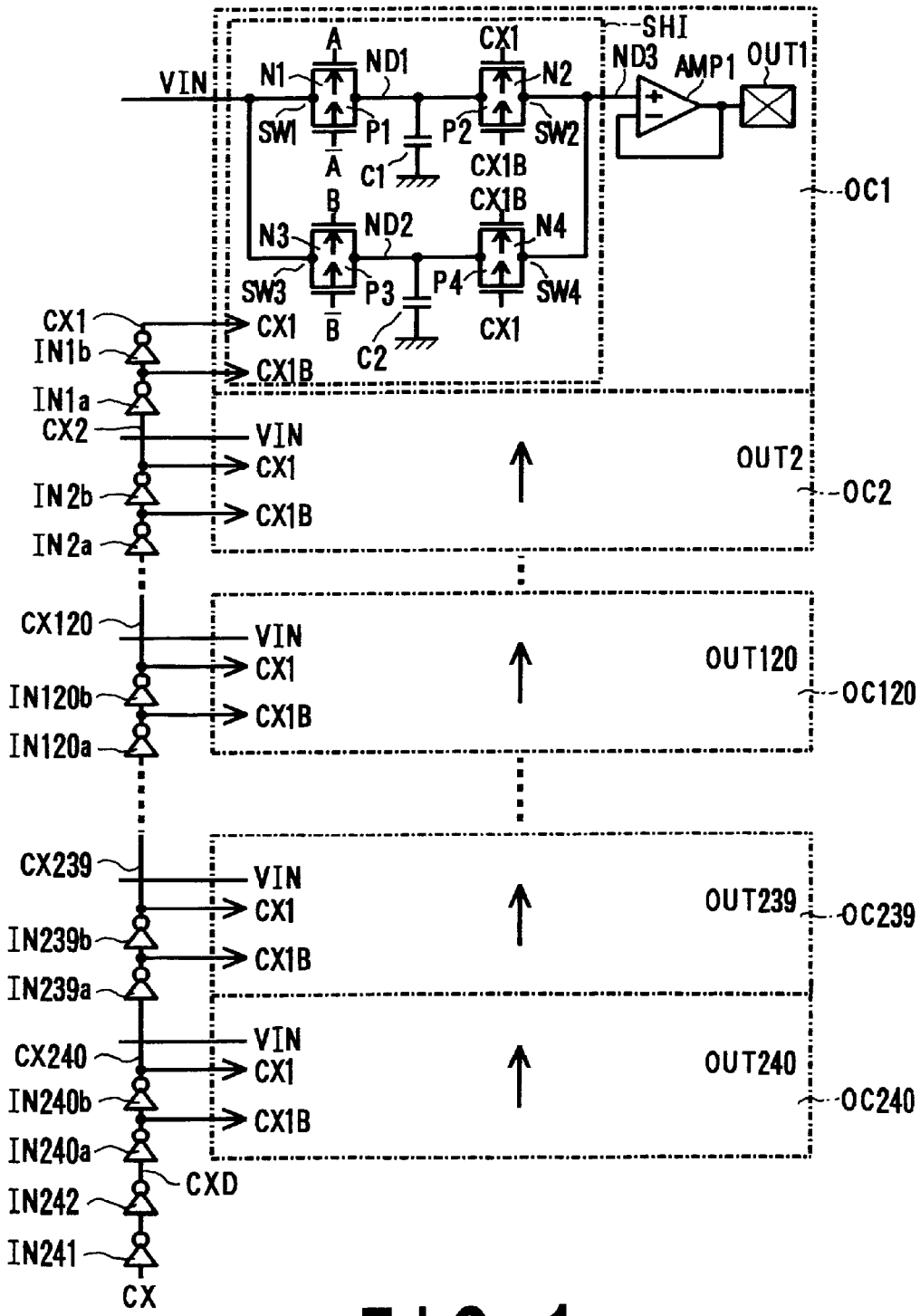
FIG. 1 is a circuit diagram showing the configuration of a liquid crystal drive circuit according to a first embodiment of this invention.
Figure 6:
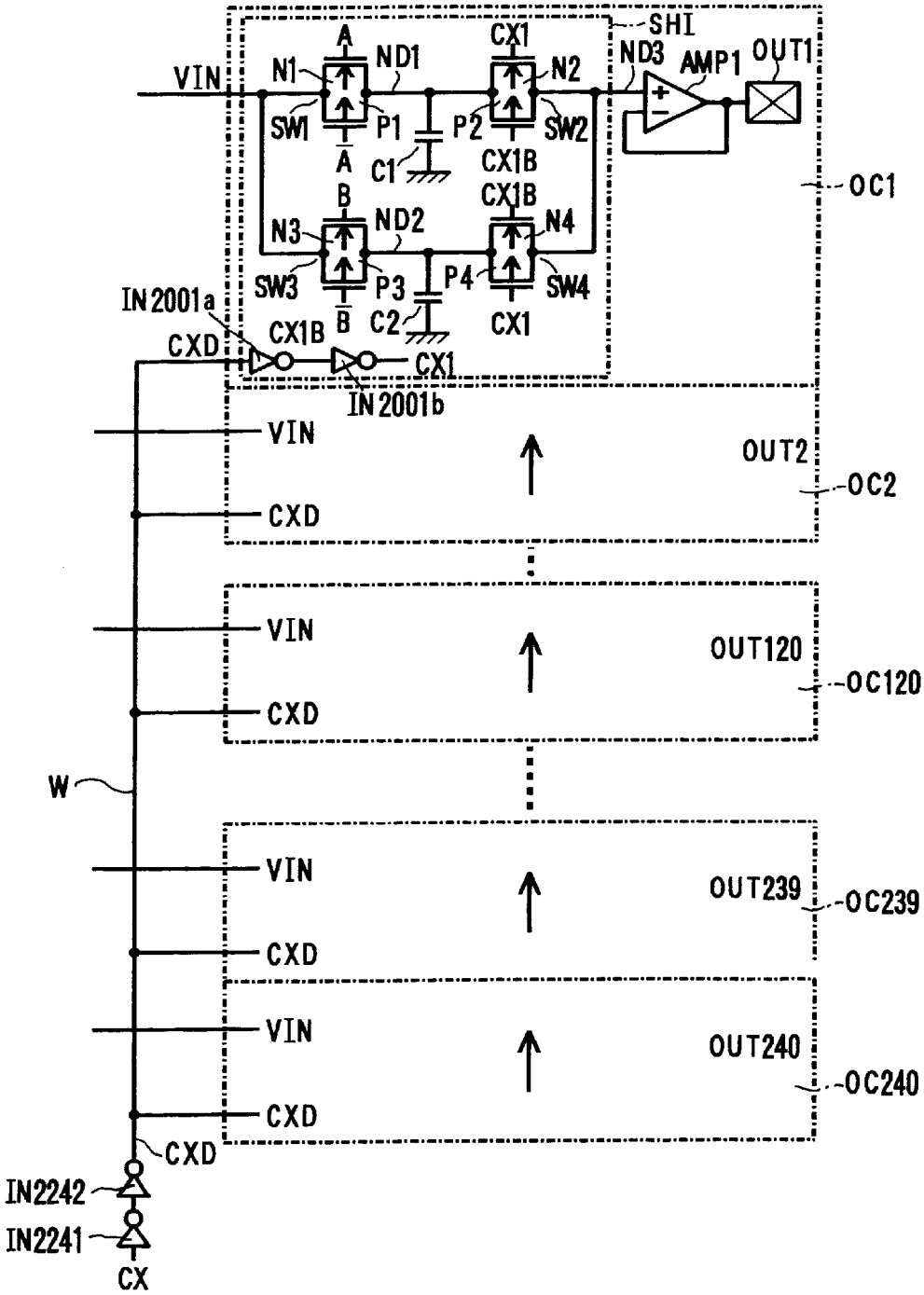
FIG. 6 is a circuit diagram showing the configuration of a liquid crystal drive circuit related to this invention.
Figure 7:
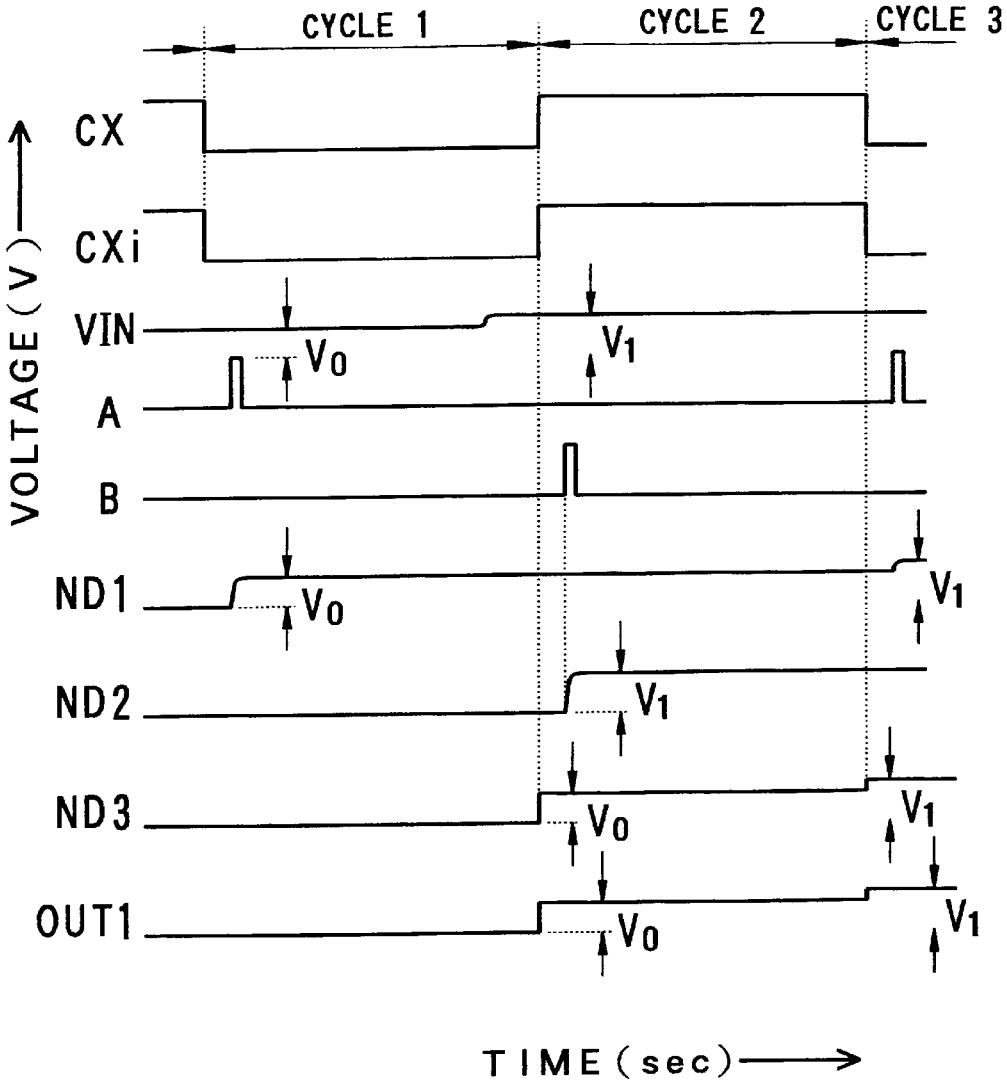
FIG. 7 is a time chart showing waveforms of respective signals in the liquid crystal drive circuit shown in FIG. 6.
Figure 8:
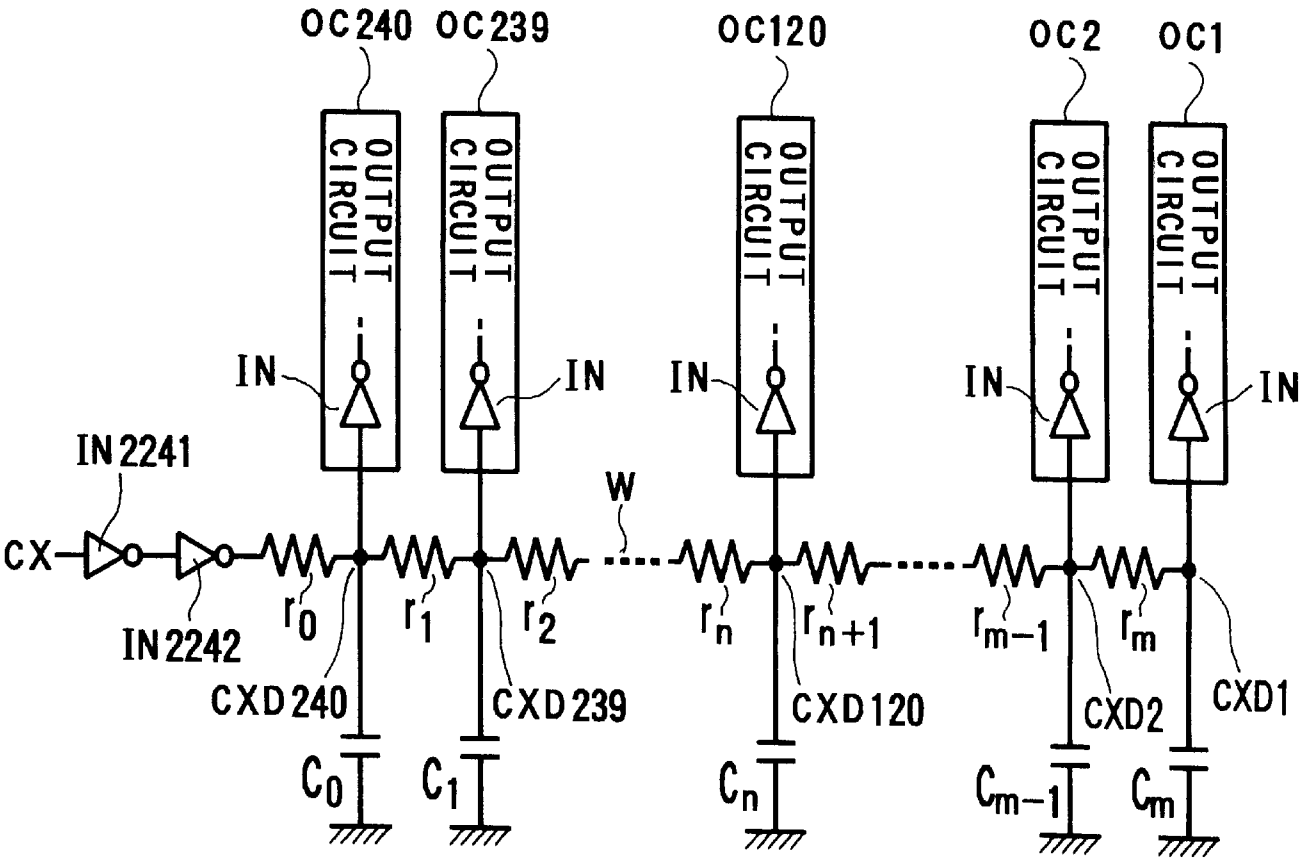
FIG. 8 is a circuit diagram showing an equivalent circuit of the liquid crystl drive circuit shown in FIG. 6.
Figure 9:
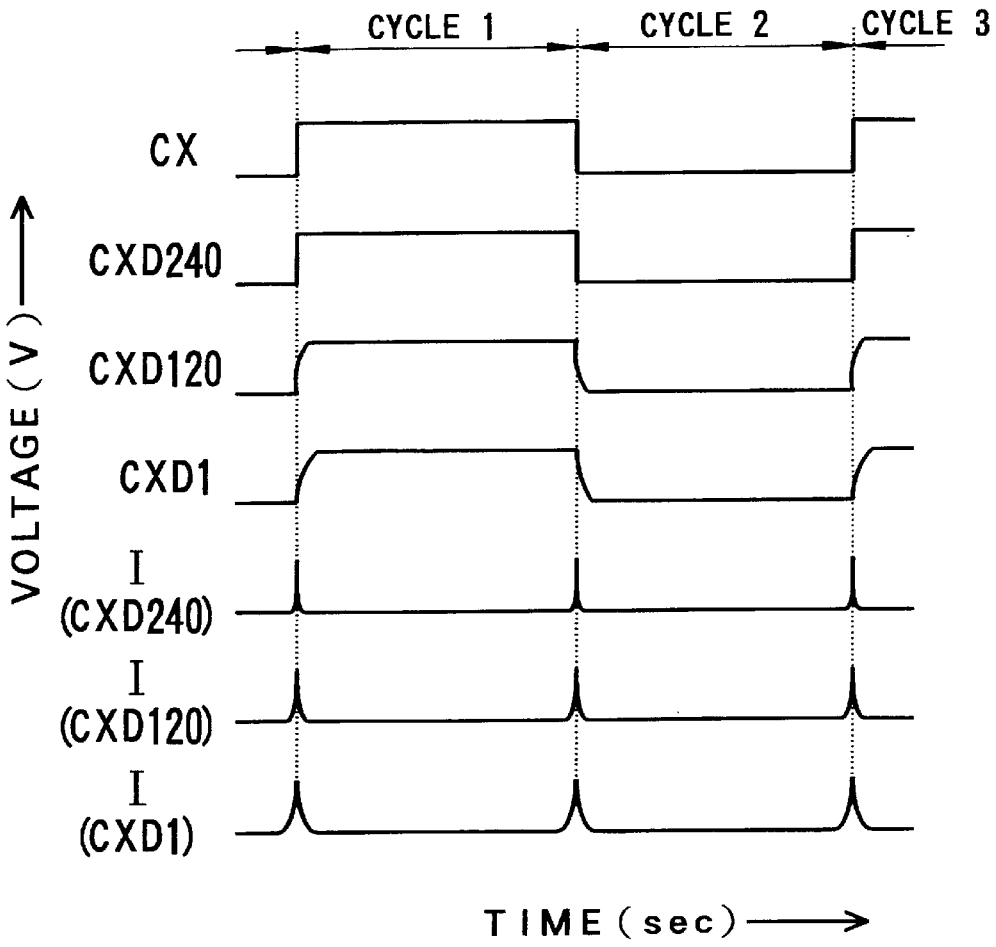
FIG. 9 is a time chart showing waveform of hold switching signal in the liquid crystal drive circuit shown in FIG. 6.

A liquid crystal drive circuit according to the first embodiment has a configuration as shown in FIG. 1, wherein 240 stages of output circuits OC1–OC240 are disposed and respective output circuits OC1–OC240 have a configuration similar to that of the output circuit OC1 shown in FIG. 6 and the same reference numerals are respectively attached to the same components.

This embodiment and the circuit shown in FIG. 6 are different from each other in connection with the following points. Hold switching signal CX is delivered from the external of the chip, and is amplified by buffer composed of inverters IN241 and IN242. Further, respective two stages of inverters IN240*a* and IN240*b*, IN239*a* and IN239*b*, . . . , IN1*a* and IN1*b* are disposed every output circuits OC240–OC1, and are all connected in series.

The output circuit OC240 is supplied with hold switching signal CX1B obtained by amplifying output signal CXD from the inverters IN241 and IN242 by inverter IN 240*a* and hold switching signal CX1 obtained by further amplifying this signal CX1B by inverter IN240*b*.

The output circuit OC239 is supplied with hold switching signal CX1B obtained by amplifying output signal CX240 from the inverter IN240*b* by inverter IN239*a* and hold switching signal CX1 obtained by further amplifying this signal CX1B by inverter IN239*b*. In a manner similar to the above, the output circuit OC238 is supplied with hold switching signals CX1B and CX1 obtained by respectively amplifying output signal CX239 from inverter IN239*b* by inverters IN238*a* and IN238*b*, . . . and the output circuit OC1 is supplied with hold switching signals CX1B and CX1 obtained by respectively amplifying output signal CX2 from the inverter IN2*b* by inverters IN1*a* and IN1*b*.

The sample-hold circuit SH1 and the amplifier AMP1 in the output circuit OC1 operate similarly to those shown in FIG. 6. Namely, the switching elements SW1–SW4 are supplied with control signals A(/A) and B(/B) or hold switching signals CX1B and CX1 so that they are turned ON/OFF. As a result, capacitor C1 or C2 is charged or dischanged every cycle by picture signal VIN. Thus, output voltage OUT1 is outputted from the amplifier AMP1.

Figure 2:
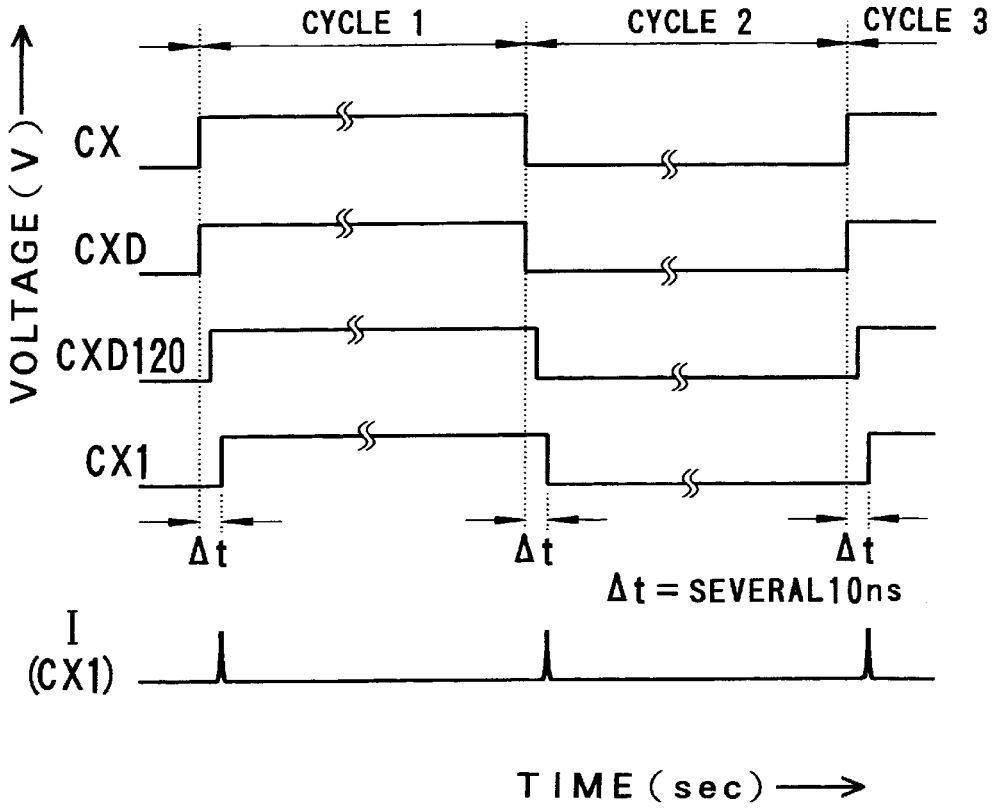
FIG. 2 is a time chart showing waveform of hold switching signal in the liquid crystal drive circuit according to the first embodiment.

Waveforms of hold switching signals CX, CXD, CX1–CX240 in this embodiment are as shown in the time chart of FIG. 2. Hold switching signal CX inputted from the external is inputted to two stages of inverters IN241 and IN242. Thus, signal CXD is generated. This signal CXD is caused to be through inverters IN240*a*, IN240*b*, IN239*a*, IN239*b*, . . . , IN120*a* and IN120*b* connected in series. Thus, signal CX120 is generated. Further, this signal CX120 is caused to be through inverters IN119*a*, IN119*b*, IN118*a*, IN118*b*, . . . , IN1*a* and IN1*b* connected in series. Thus, signal CX1 is generated.

The signal CX1 is delayed by time Δt (several 10 nsec) from the signal CX. However, one period (time of one cycle) of the hold switching signal is, e.g., 35 μsec. Such a delay time has no hindrance on the operation. Accordingly, this time can be almost disregarded. Rather, as the result of the fact that the hold switching signal is delayed by time Δt, there is no possibility that switching elements are turned ON or OFF at the same time in all output circuits OC. For this reason, noises by switching operation are distributed without occurring at the same timing. Accordingly, noise superimposed on the power line can be lessened rather than that of the circuit shown in FIG. 6.

Further, since the hold switching signal is amplified by inverter trains provided every respective output circuits OC, waveform at the stage where that signal is inputted to each output circuit OC is (waveform-)shaped. As a result, the portion of the edge is sharp similarly to the signal CX. Thus, feed-through current I(IN1) flowing in the inverter IN1 (IN1*a*, IN1*b*) supplied with the amplified signal CX takes small value as shown in FIG. 2. Thus, power consumption is reduced.

Figure 3:
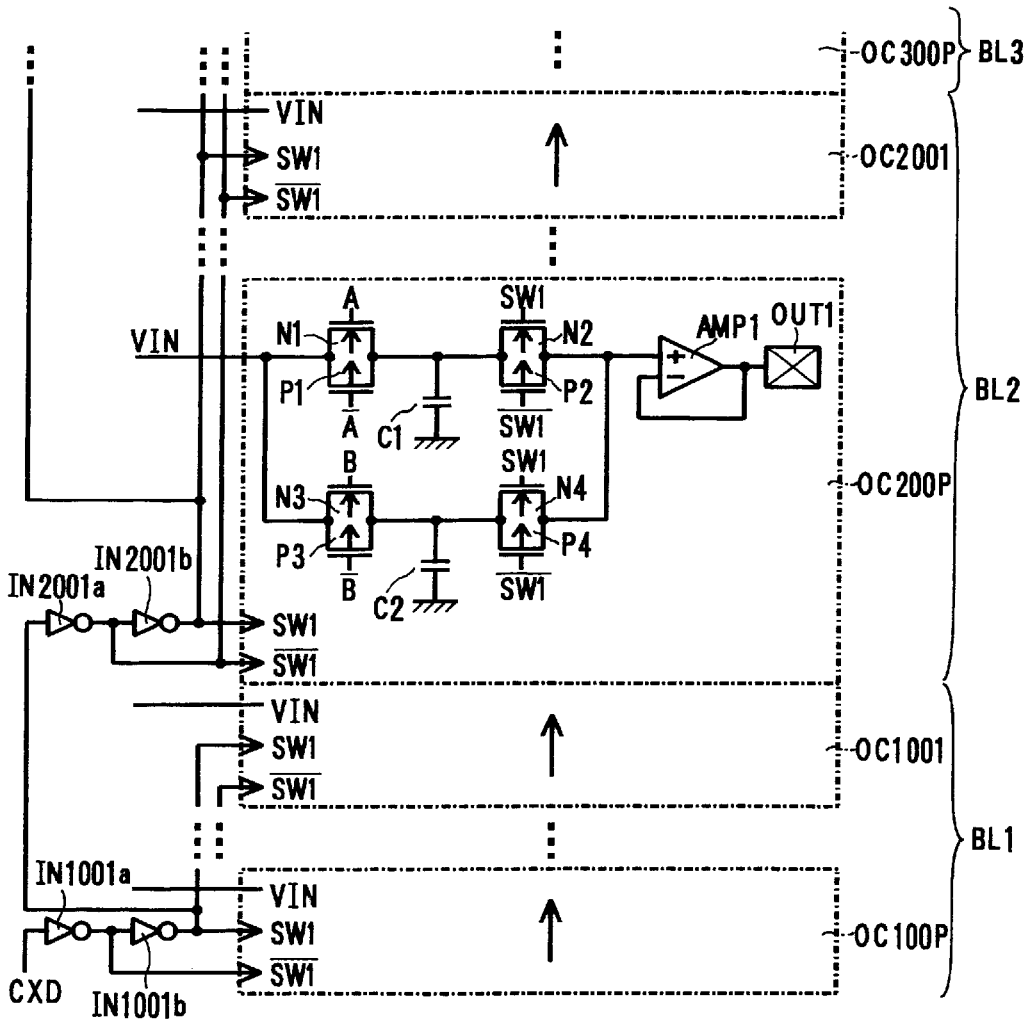
FIG. 3 is a circuit diagram showing the configuration of a liquid crystal drive circuit according to a second embodiment of this invention.

The liquid crystal drive circuit according to the second embodiment of this invention has a configuration as shown in FIG. 3. In the first embodiment, respective two stages of inverters IN are disposed every output circuits OC1–OC240. Thus, the signal waveform is shaped. On the contrary, this embodiment is characterized in that p (p is integer of 2 or more) number of output circuits OC are caused to be one block BL and two stages of inverter trains are disposed every respective blocks. It is to be noted that when value of p is set to large value, wiring resistance and wiring capacitance until signal reaches the output circuit OC of the final stage within the same block are increased. As a result, rounding of the portion of the edge of waveform of the hold switching signal becomes large. In view of the above, it is preferable to set value of p to such a degree that rounding of the waveform does not constitute problem.

In more practical sense, block BL1 is formed with respect to (or is constituted by) p number of output circuits OC1001–OC100*p*, block BL2 is formed with respect to output circuits OC2001–OC200*p*, and block BL3 is formed with respect to output circuits OC3001–OC300*p*, . . . . Hold switching signal CXD is inputted from the external, and signal /SW1 amplified by inverter IN1001*a* disposed at the block BL1 and signal SW1 amplified by the inverter IN1001*b* disposed at the same block are inputted to output circuits OC1001–OC100*p* within this block BL1.

Moreover, signal outputted from the inverter IN1001*b* is inputted to the inverter IN2001*a* disposed at the block BL2. As a result, signal /SW1 is outputted. Further, this signal /SW1 is inputted to the inverter IN2001*b*. As a result, signal SW1 is outputted. This signal SW1 is delivered to the output circuits OC2001–OC200*p*.

In accordance with this embodiment, since rounding of waveform of hold switching signal can be suppressed similarly to the above-mentioned first embodiment, feed-through current flowing in the inverter is reduced. Thus, power consumption is reduced. Further, since the number of inverters for transmission of hold switching signal of the entirety of the circuit is small as compared to the first embodiment in accordance with this embodiment, the chip area and the cost can be reduced.

Figure 4:
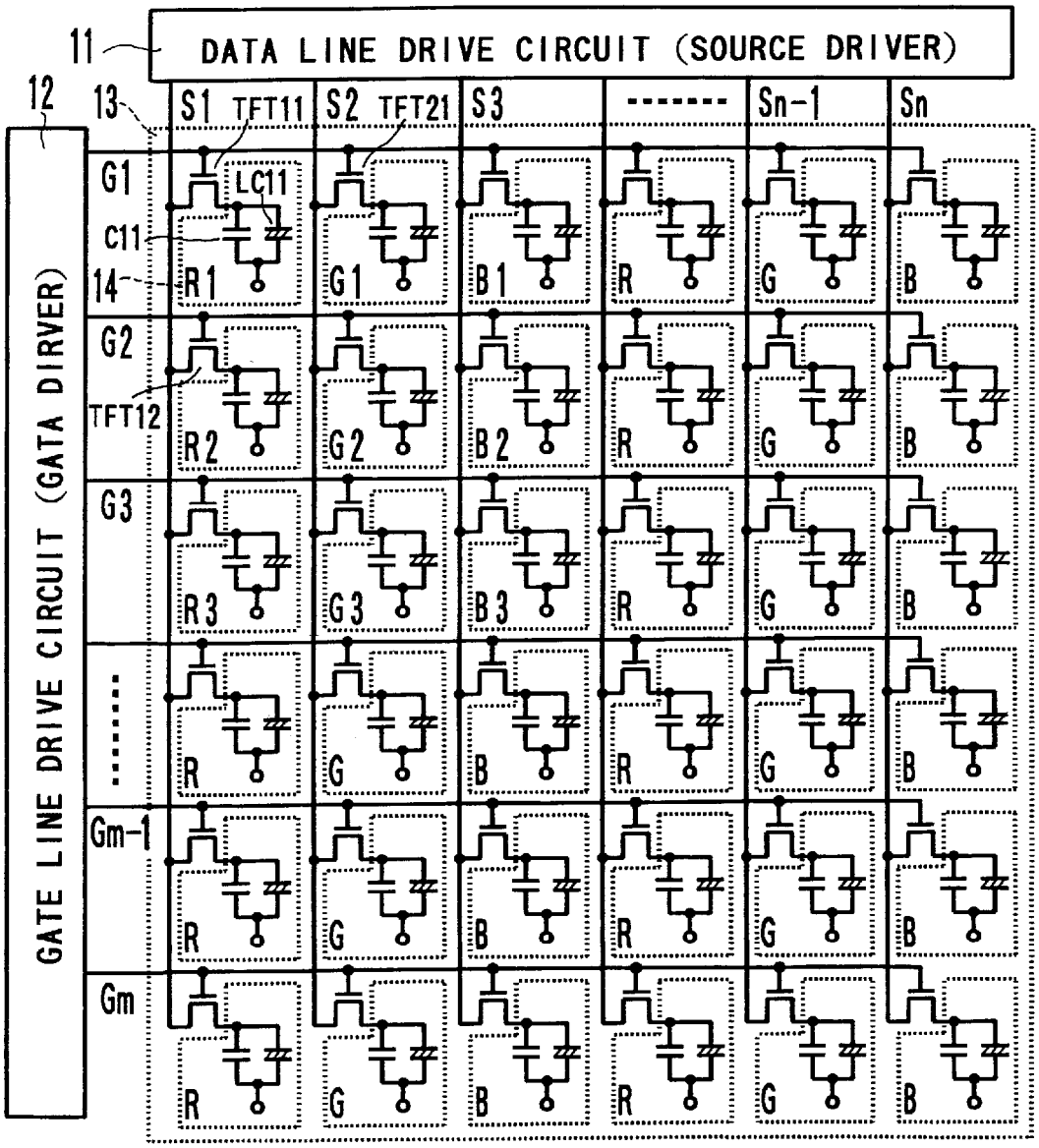
FIG. 4 is a circuit diagram showing the cofiguration of a liquid crystal display device according to one embodiment of this invention.
Figure 5:
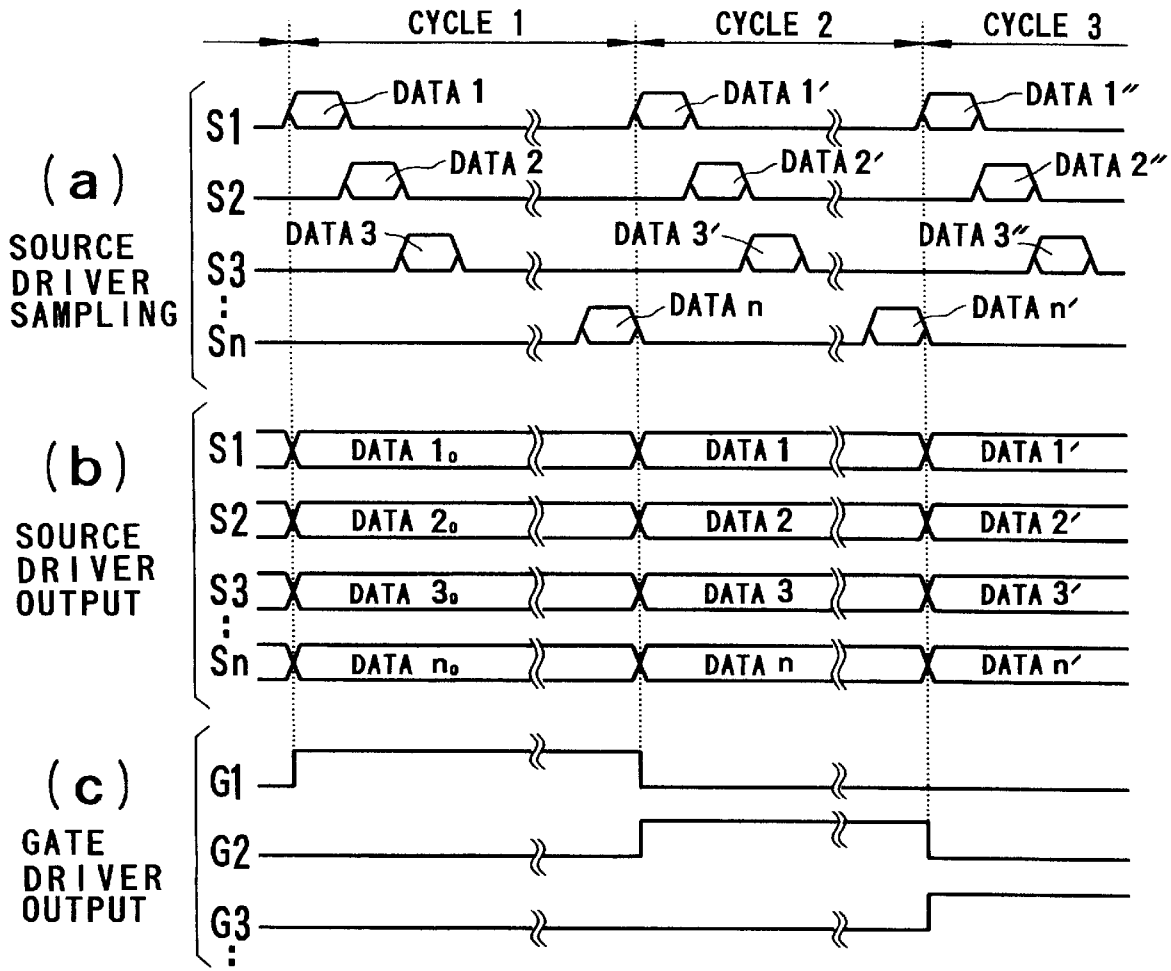
FIG. 5 is a time chart showing waveforms of respective signals in the liquid crystal display device according to one embodiment.

The configuration of the liquid crystal display device according to one embodiment of this invention is shown in FIG. 4, and respective waveforms of signals for controlling the device are shown in FIG. 5. This device corresponds to the device in which the liquid crystal drive circuit according to the first or second embodiment is used as data line drive circuit (hereinafter referred to as source driver) 11. Pixel electrodes 14 are arranged in a matrix form of n×m (n and m are integer of 2 or more, and n=m may hold) on one surface of a liquid crystal panel 13 encompassed by dotted lines, and common electrode is disposed on the other surface corresponding thereto. Equivalent capacitances LC11–LCnm and parasitic capacitances C11–Cnm that the liquid crystal panel 13 has exist every respective pixels. Respective one terminals of the capacitances LC11–LCnm and C11–Cnm are connected to the common electrode, and respective the other terminals are connected to drains of thin film transistors (hereinafter referred to as TFT) TFT11–TFTnm. Respective sources of the TFT11–TFTnm are connected to n number of data lines S1, S2, . . . , Sn in the X-direction, and respective gates are connected to m number of gate lines G1, G2, . . . , Gm in the Y-direction. The data lines S1–Sn are driven by the source driver 11, and gate lines G1–Gm are driven by gate line drive circuit (hereinafter referred to as gate driver) 12.

The gate driver 12 outputs, in succession, outputs of which levels are switched every cycles 1, 2, 3, . . . to gate lines G1, G2, . . . as shown in FIG. 5. Thus, TFTs of one line (column) in the Y-direction are turned ON. The source driver 11 samples, in succession, signals on n number of data lines S1–Sn at this 1 cycle. Sampling in this case corresponds to switching timing of hold operation of the liquid crystal drive circuit in the above-mentioned first and second embodiments, and level of the hold switching signal is switched to high level or low level at cycle obtained by equally dividing the cycle where output level of the gate driver 12 is switched by 2n. In other words, in accordance with timing obtained by dividing cycle in the gate driver 12 by n, output voltages OUT1, OUT2, . . . stored in the capacitor C1 or C2 are outputted in succession to data lines S1, S2, . . . as data 1, 2, . . . , and are delivered to liquid crystal elements every pixels through TFTs. Thus, picture images corresponding to those data are displayed.

In accordance with the liquid crystal display device according to this embodiment, since the liquid crystal drive circuit according to the first or second embodiment is used as the source driver 11, rounding of waveform of hold switching signal in the source driver 11 is suppressed. As a result, feed-through current is decreased. Thus, power consumption can be reduced.

The above-described embodiments are presented only for illustrative purpose, and therefore do not limit this invention in any sense. For example, more practical configuration of the sample-hold circuit shown in FIG. 1 or FIG. 3 may be modified. There may be employed a sample-hold circuit capable of switching, every predetermined period, the operation for holding picture signal to output it. In addition, while buffer composed of two stages of inverters connected in series is used as the waveform shaper, buffer or similar circuit element capable of shaping waveform may be employed without being limited to the above.

What is claimed is:

1. A liquid crystal drive circuit in which there are provided n (n is integer of 2 or more) number of output circuits supplied with picture signals to generate and output drive signals for driving a liquid crystal panel, each of the output circuits comprising a sample-hold circuit including a first charge storage section and a second charge storage section connected in parallel, the sample-hold circuit being supplied with the picture signal and a hold switching signal to store the picture signal into either one of the first charge storage section and the second charge storage section alternately in accordance with the hold switching signal and output the picture signal, and waveform shapers are provided to each of said output circuits, the waveform shapers being connected to each other in series, the hold switching signal being inputted to the waveform shapers so that the hold switching signal is propagated in succession, outputs from respective ones of the waveform shapers being delivered to corresponding ones of the output circuits.

2. A liquid crystal drive circuit as set forth in claim 1, wherein the sample-hold circuit is such that the first charge storage section is provided at a first path and the second charge storage section is provided at a second path connected in parallel with the first path, the sample-hold circuit being supplied with the picture signal and the hold switching signal of which level is switched every predetermined period to store the picture signal into either one of the first charge storage section and the second charge storage section alternately in accordance with the hold switching signal and output the picture signal.

3. A liquid crystal drive circuit as set forth in claim 2, wherein the sample-hold circuit is such that both ends of a first switching element, one end of a first capacitor corresponding to the first charge storage section and having the other end grounded, and both ends of a second switching element are connected in series so that the first path is formed, that both ends of a third switching element, one end of a second capacitor corresponding to the second charge storage section and having the other end grounded, and both ends of a fourth switching element are connected in series so that the second path is formed, and that the second switching element and the fourth switching element are respectively turned ON or OFF responsive to the hold switching signal and/or an inverted hold switching signal, and the first switching element and the third switching element are respectively turned ON or OFF responsive to a control signal to produce pulse once at the predetermined period which is the same as that of the hold switching signal and/or an inverted control signal.

4. A liquid crystal drive circuit as set forth in claim 3, wherein the waveform shapers are constituted as respective inverter trains in which first and second inverters are respectively provided every the output circuits, and connected to each other in series, and the hold switching signal is propagated by the inverter trains, whereby the hold switching signal and the inverted hold switching signal outputted from the first and second inverters of corresponding one of the output circuits are respectively delivered to the second and fourth switching elements within the corresponding one of the output circuits.

5. A liquid crystal drive circuit as set forth in claim 1, further comprising amplifiers supplied with outputs of the respective sample-hold circuits to amplify and output the outputs as the respective drive signals.

6. A liquid crystal drive circuit in which there are provided n number of output circuits supplied with picture signals to generate and output drive signals for driving a liquid crystal panel, each of the output circuits comprising a sample-hold circuit including a first charge storage section and a second charge storage section connected in parallel, the sample-hold circuit being supplied with the picture signal and a hold switching signal to store the picture signal into either one of the first charge storage section and the second charge storage section alternately in accordance with the hold switching signal and output the picture signal, and waveform shapers are respectively provided to every p (p is integer smaller than the n) number of output circuits caused to be one block, the waveform shapers being connected to each other in series, the hold switching signal inputted from the external being inputted to the waveform shapers so that the hold switching signal is propagated, whereby outputs from respective ones of the waveform shapers are delivered to the output circuits belonging to corresponding ones of the blocks.

7. A liquid crystal drive circuit as set forth in claim 6, wherein the sample-hold circuit is such that the first charge storage section is provided at a first path and the second charge storage section is provided at a second path connected in parallel with the first path, the sample-hold circuit being supplied with the picture signal and the hold switching signal of which level is switched every predetermined period to store the picture signal into either one of the first charge storage section and the second charge storage section alternately in accordance with the hold switching signal and output the picture signal.

8. A liquid crystal drive circuit as set forth in claim 7, wherein the sample-hold circuit is such that both ends of a first switching element, one end of a first capacitor corresponding to the first charge storage section and having the other end grounded, and both ends of a second switching element are connected in series so that the first path is formed, that both ends of a third switching element, one end of a second capacitor corresponding to the second charge storage section and having the other end grounded, and both ends of a fourth switching element are connected in series so that the second path is formed, and that the second switching element and the fourth switching element are respectively turned ON or OFF responsive to the hold switching signal and/or an inverted hold switching signal, and the first switching element and the third switching element are respectively turned ON or OFF responsive to a control signal to produce pulse once every the predetermined period which is the same as that of the hold switching signal and/or an inverted control signal.

9. A liquid crystal drive circuit as set forth in claim 8, wherein the waveform shapers are constituted as respective inverter trains in which first and second inverters are respectively provided every p number of the output circuits caused to be one block and connected to each other in series, and the hold switching signal is propagated by the inverter trains, whereby the hold switching signal and the inverted hold switching signal outputted from the first and second inverters provided at corresponding one of the respective blocks being respectively delivered to the second and fourth switching elements within the output circuits belonging to the corresponding one of the blocks.

10. A liquid crystal drive circuit as set forth in claim 6, further comprising amplifiers supplied with outputs of the respective sample-hold circuits to amplify and output the outputs as the respective drive signals.

11. A liquid crystal display device comprising:

pixel electrodes arranged in a matrix form of n×m (n, m are integer of 2 or more);

(n×m) number of liquid crystal drive transistors arranged in a manner respectively corresponding to the pixel electrodes and having their drains respectively connected to corresponding ones of the pixel electrodes;

n number of data lines having their one ends respectively connected to sources of the liquid crystal drive transistors;

m number of gate lines having their one ends respectively connected to gates of the liquid crystal drive transistors;

gate drivers connected to other ends of the gate lines and operative to drive the gate lines in succession in accordance with a first period; and source drivers connected to other ends of the data lines and such that there are provided plural output circuits supplied with picture signals to generate and output data line drive signals for driving the data lines respectively, each of the output circuits of the source drivers comprising a sample-hold circuit including a first charge storage section and a second charge storage section connected in parallel, the sample-hold circuit being supplied with the picture signal and a hold switching signal to store the picture signal into either one of the first charge storage section and the second charge storage section alternately in accordance with the hold switching signal and output the picture signal, waveform shapers are provided to each of said output circuits, the waveform shapers being connected to each other in series, the hold switching signal being inputted to the waveform shapers so that the hold switching signal is propagated in succession, whereby outputs from respective ones of the waveform shapers are delivered to corresponding ones of the output circuits.

12. A liquid crystal display device as set forth in claim 11, wherein the sample-hold circuit is such that the first charge storage section is provided at a first path and the second charge storage section is provided at a second path connected in parallel with the first path, the sample-hold circuit being supplied with the picture signal and the hold switching signal of which level is switched every second period obtained by substantially dividing the first period by 2n to store the picture signal into either one of the first charge storage section and the second charge storage section alternately in accordance with the hold switching signal and output the picture signal.

13. A liquid crystal display device as set forth in claim 12, wherein the sample hold circuit is such that both ends of a first switching element, one end of a first capacitor corresponding to the first charge storage section and having the other end grounded, and both ends of a second switching element are connected in series so that the first path is formed, that both ends of a third switching element, one end of a second capacitor corresponding to the second charge storage section and having the other end grounded, and both ends of a fourth switching element are connected in series so that the second path is formed, and that the second switching element and the fourth switching element are respectively turned ON or OFF responsive to the hold switching signal and/or an inverted hold switching signal, and the first switching element and the third switching element are respectively turned ON or OFF responsive to a control signal to produce pulse once every the second period and/or an or the inverted control signal.

14. A liquid crystal display device as set forth in claim 13, wherein the waveform shapers are constituted as respective inverter trains in which first and second inverters are respectively provided every the output circuits, and connected to each other in series, and the hold switching signal being propagated by the inverter trains, the hold switching signal and the inverted hold switching signal outputted from the first and second inverters of corresponding one of the output circuits being respectively delivered to the second and fourth switching elements within the corresponding one of the output circuits.

15. A liquid crystal circuit drive as set forth in claim 1, further comprising amplifies supplied with outputs of the respective sample-hold circuits to amplify and output the outputs as the respective data line drive signals.

16. A liquid crystal display device comprising:

pixel electrodes arranged in a matrix form of n×m;

(n×m) number of liquid crystal drive transistors arranged in a manner respectively corresponding to the pixel electrodes and having their drains respectively connected to corresponding ones of the pixel electrodes;

n number of data lines having their one ends respectively connected to sources of the liquid crystal drive transistors;

m number of gate lines having their one ends respectively connected to gates of the liquid crystal drive transistors;

gate drivers connected to other ends of the gate lines and operative to drive the gate lines in succession in accordance with a first period; and source drivers connected to other ends of the data lines and such that there are provided plural output circuits supplied with picture signals to generate and output data line drive signals for driving the data lines respectively, each of the output circuits of the source drivers comprising a sample-hold circuit including a first charge storage section and a second charge storage section connected in parallel, the sample-hold circuit being supplied with the picture signal and a hold switching signal to store the picture signal into either one of the first charge storage section and the second charge storage section alternately in accordance with the hold switching signal, waveform shapers are respectively provided to every p number of output circuits caused to be one block, the waveform shapers being connected to each other in series, the hold switching signal being inputted to the waveform shapers so that the hold switching signal is propagated, whereby outputs from respective ones of the waveform shapers are delivered to the output circuits belonging to corresponding ones of the blocks.

17. A liquid crystal display device as set forth in claim 16, wherein the sample-hold circuit is such that the first charge storage section is provided at a first path and the second charge storage section is provided at a second path connected in parallel with the first path, the sample-hold circuit being supplied with the picture signal and the hold switching signal of which level is switched every second period obtained by substantially dividing the first period by 2n to store the picture signal into either one of the first charge storage section and the second charge storage section alternately in accordance with the hold switching signal.

18. A liquid crystal display device as set forth in claim 17, wherein the sample-hold circuit is such that both ends of a first switching element, one end of a first capacitor corresponding to the first charge storage section and having the other end grounded, and both ends of a second switching element are connected in series so that the first path is formed, that both ends of a third switching element, one end of a second capacitor corresponding to the second charge storage section and having the other end grounded, and both ends of a fourth switching element are connected in series so that the second path is formed, and that the second switching element and the fourth switching element are respectively turned ON or OFF responsive to the hold switching signal and/or an inverted hold switching signal, and the first switching element and the third switching element are respectively turned ON or OFF responsive to a control signal to produce pulse once at the second period and/or an inverted control signal.

19. A liquid crystal display device as set forth in claim 18, wherein the waveform shapers are constituted as respective inverter trains in which first and second inverters are respectively provided every the output circuits, and connected to each other in series, and the hold switching signal is propagated by the inverter trains, whereby the hold switching signal and the inverted hold switching signal outputted from the first and second inverters provided at corresponding one of the respective blocks being respectively delivered to the second and fourth switching elements within the output circuits belonging to the corresponding one of the blocks.

20. A liquid crystal drive circuit as set forth in claim 16, further comprising amplifies supplied with outputs of the respective sample-hold circuits to amplify and output the outputs as the respective data line drive signals.

* * * * *